US005575761A

United States Patent [19]

Hajianpour

[11] Patent Number: 5,575,761

[45] Date of Patent: Nov. 19, 1996

[54] MASSAGE DEVICE APPLYING VARIABLE-FREQUENCY VIBRATION IN A VARIABLE PULSE SEQUENCE

[76] Inventor: Mohammed-Ali Hajianpour, 1706 Vestal Dr., Coral Springs, Fla. 33071

[21] Appl. No.: 281,485

[22] Filed: Jul. 27, 1994

[51] Int. Cl.[6] ..... A61H 1/00

[52] U.S. Cl. ..... 601/48; 601/71; 601/79; 601/70

[58] Field of Search ..... 601/46, 48, 70, 601/71, 72, 74, 78

[56] References Cited

U.S. PATENT DOCUMENTS

| | | | |
|---|---|---|---|
| Re. 31,603 | 6/1984 | Christensen | 601/48 |
| 2,742,036 | 4/1956 | Montesano | 601/46 |
| 3,024,783 | 3/1962 | Timcke | 601/46 |
| 4,887,594 | 12/1989 | Siegel | 601/71 |
| 5,022,384 | 6/1991 | Freels | 601/70 |
| 5,115,769 | 5/1992 | Fiorini . | |
| 5,334,131 | 8/1994 | Omandam | 601/70 |
| 5,437,608 | 8/1995 | Cutler | 601/48 |

OTHER PUBLICATIONS

Ronald Melzack and Patrick D. Wall, Nov. 19, 1965 issue of *Science* Magazine, vol. 150, No. 3699, pp. 971–979.

*Primary Examiner*—Robert A. Hafer
*Assistant Examiner*—Brian E. Hanlon
*Attorney, Agent, or Firm*—Ronald V. Davidge

[57] ABSTRACT

A vibrating massager includes a housing and an elastic strap, which is fastened into a loop to hold a protrusion extending from a surface of the housing against a pressure point of the human body. Mechanical vibrations, produced by a small electric motor spinning an eccentrically mounted weight, are transmitted to the protrusion. The motor is driven according to a pattern of pulses, between which the vibrations are interrupted. The length of time between vibrating pulses is adjusted with a first know on the device. The speed of the motor is adjusted using a second knob on the device, varying the frequency and amplitude of the vibrations. An extension strap is used to facilitate attachment of the strap around larger body members such as the head, as well as around smaller body members, such as the wrist.

15 Claims, 3 Drawing Sheets

MASSAGE DEVICE APPLYING VARIABLE-FREQUENCY VIBRATION IN A VARIABLE PULSE SEQUENCE

BACKGROUND OF THE INVENTION

1. Field of the Invention

This invention relates to a portable vibrating massage device, and more particularly, to a portable vibrating device having controls for adjusting the frequency and sequential pulse timing of vibrations.

2. Background Information

On a world-wide basis, a number of pain-control benefits have been associated with the application of localized pressure and vibrations to various parts of the human body. In some instances headaches can be reduced by applying vibration to various locations on the head, and wrist pain may be helped by applying vibration to certain areas of the wrist. A maximum benefit occurs when such pressure and vibrations are applied to particular pressure points, on the surface of the human body. For example, vibration may be directed at nerve endings under the skin.

Vibration may achieve pain control in some instances by tending to overwhelm the sensory system, reducing the ability of other messages, resulting from painful stimuli, to pass through the system. A theory which may further explain the benefits of vibration is the gate control theory of pain, which is discussed by Ronald Melzack and Patrick D. Wall in the Nov. 19, 1965 issue of *Science* Magazine, Volume 150, Number 3699, pages 971–979. This theory proposes that the substantia gelatinosa, which consists of small, densely packed cells forming a functional unit extending the length of the spinal column forms a gate control system modulating afferent patterns from stimuli before they influence the central transmission (T) cells. Thus, the substantia gelatinosa acts as a gate control system modulating the synaptic transmission of nerve impulses from peripheral nerves to central cells. According to this theory, three features which are important to the afferent input of impulses from a painful stimulus (i.e. to the process of bringing such impulses toward a nerve center) are the ongoing activity preceding the stimulus, the stimulus-evoked activity, and the relative balance of activity in large versus small nerve fibers.

Melzack and Wall describe a scenario in which the spinal cord is continually bombarded by incoming nerve stimuli, even in the absence of obvious stimulation, with this ongoing activity being carried predominantly by small nerve fibers, which adapt slowly, as the gate is held in a relatively open position. If a gentle pressure stimulus is applied suddenly to the skin, the afferent volley of impulses contains large-fiber impulses, which fire the T cells, and which partially close the presynaptic gate, shortening the barrage of impulses generated by the T cells. If the intensity of the stimulus is increased, more receptor-fiber units are recruited, and the firing frequency of active units is increased, bringing about a situation in which the large-fiber and small-fiber inputs tend to counteract each other, as the output of the T cells rises slowly. If stimulation is prolonged, the large fibers begin to adapt, producing a relative increase in small-fiber activity, as the gate is opened further, so that the output of the T cells rises more steeply. However, if the large-fiber steady background activity is artificially raised at this time by vibration or scratching, in a maneuver that overcomes the tendency of large fibers to adapt, the output of the cells decreases.

Melzack and Wall further suggest that there is a temporal and spatial summation, or integration, of the arriving barrage of impulses by the T cells, with the signal triggering the action system responsible for pain experience and response occurring when the output of T cells reaches or exceeds a critical level. While vibration activates fibers of all diameters, it activates a larger proportion of A fibers, which tend to adapt during constant stimulation. While vibration sets the gate in a more close position, the same impulses which set the gate bombard the T cells, summating, for example, with impulses produced by a painful stimulation. Certain behavioral observation indicates that vibration reduces low-intensity pain but enhances high intensity pain.

Since both the different types of pain stimuli, and the various physiological responses to pain stimuli are so varied, any attempt to alleviate pain through the use of vibration should be carried out with equipment having the greatest flexibility in developing different types of vibrations, and in applying these vibrations to the human body. For example, such equipment should provide a means for varying the intensity of vibrations, by varying both the frequency and amplitude of vibrations. Because of the temporal summation effect described by Melzack and Wall, such equipment should have a capability to produce a sequence of vibration pulses, each of which terminates before the pain enhancing effect of summation overcomes the benefits obtained by closing the "gate." Since the benefits of a pain control device using vibration are determined most effectively by the user of the device, controls should be provided on the device to allow the efficient variation of the vibration pattern produced. What is particularly needed is the incorporation of this kind of flexibility into a device which is equipped to maintain suitable contact with the body as it is carried around in use.

One method which has been used to induce vibration, in small devices not used for pain control, is the rotation of a small direct-current motor having an eccentric weight attached to its shaft. Such a motor can be easily driven by means of a small battery. This method has been used, for example, in a pager having a capability of alerting its user that a message has been received by vibrating instead of by producing an audible signal.

SUMMARY OF THE INVENTION

In accordance with one aspect of the invention, there is provided a vibrating massager including a first pulse generating circuit, a vibration generating mechanism, and a vibration transmission mechanism. The first pulse generating circuit forms a first series of electrical pulses. This circuit includes a way to vary each first variable time, occurring between a pulse transition occurring in a first direction and a next pulse transition in a direction opposite the first direction. The vibration generating mechanism produces mechanical vibrations as it is driven according to the first series of electrical pulses. The vibration transmission mechanism transmits mechanical vibrations produced by the vibration generating means to an exterior surface of the massager.

BRIEF DESCRIPTION OF THE DRAWINGS

One preferred embodiment of the subject invention is hereafter described, with specific reference being made to the following Figures, in which.

DETAILED DESCRIPTION

Figure 1:
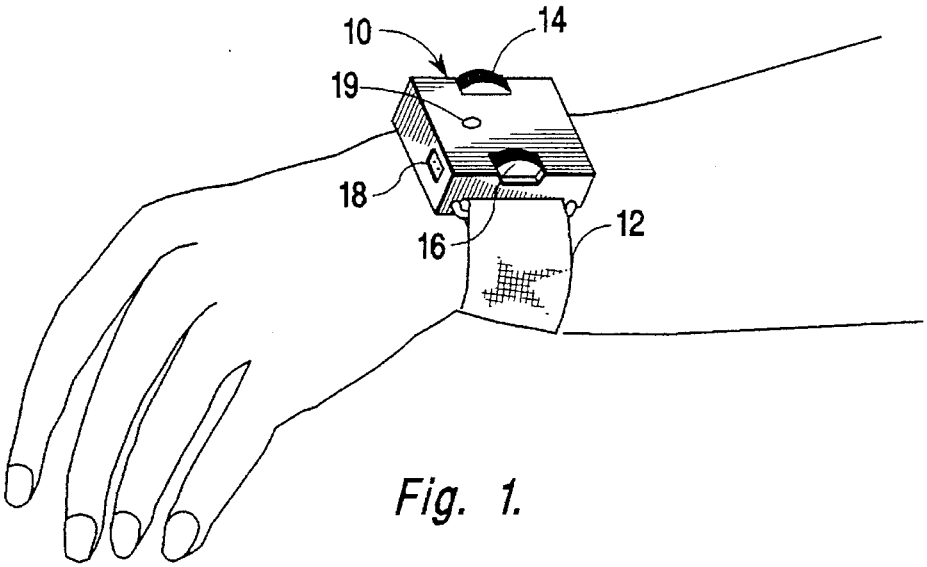
FIG. 1 is an isometric view of a vibrating massager built in accordance with the present invention, in use in the application of vibration to the upper side of a user's wrist.
Figure 2:
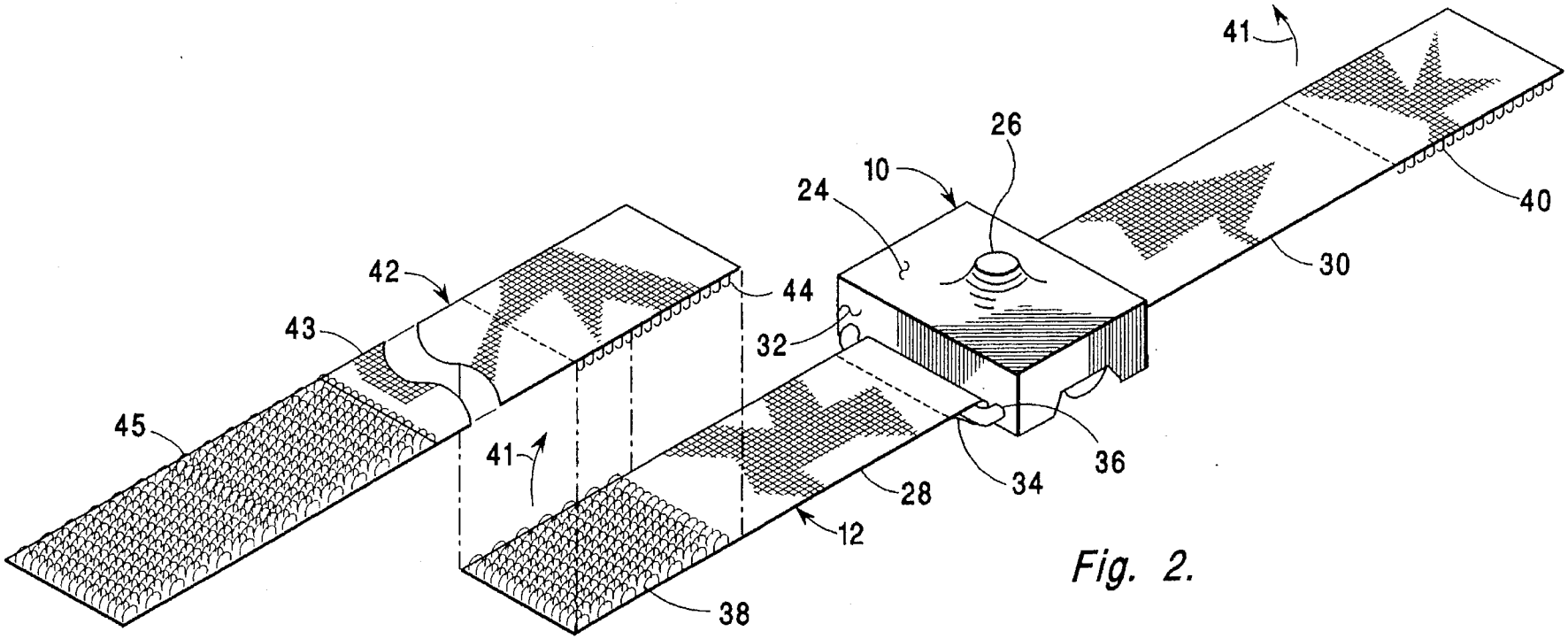
FIG. 2 is an isometric view showing particularly an underside of the massager of FIG. 1, together with an extension strap which may be applied to the massager of FIG. 1.

FIGS. 1 and 2 are isometric views of a massage device built in accordance with the present invention. FIG. 1 shows the application of the massage device to the wrist to alleviate wrist pain, while FIG. 2 shows the underside of the massage device, in an exploded relationship with an extension strap which may be used with the device.

Referring first to FIG. 1, the massage device 10 may include a short strap 12, which may be fastened around the wrist of the user to hold the massage device in a place where the vibration of the massage device is applied particularly to alleviate wrist pain. As seen from above, the massage device includes a frequency control knob 14, controlling the frequency of vibrations produced by the massage device, and a duty cycle control knob 16, controlling the duration of the time inserted between six-second vibration pulses produced by the massage device. Using this knob 14, this idle time between pulses can be adjusted from about 0.1 second to about 20 seconds. When the shortest delay is selected, the device 10 is perceived to operate continuously. A side of the massage device 10 includes an electrical socket 18 for the attachment of a battery charger (not shown) to renew the electrical charge in batteries within the massage device. An LED 19 (light-emitting diode) indicates when the source of vibrations within device 10 is turned on.

Referring to FIG. 2, the underside 24 of massage device 10 includes a central protrusion 26, which is shaped particularly to concentrate the effects of pressure and vibration at a particular point on the human body. Central protrusion 26 is particularly useful in locating the point of application of vibration and pressure at a suitable pressure point on the human body. Strap 12 is divided into a first strap portion 28 and a second strap portion 30, each of which is fastened to the case 32 of massage device 10 by sewing an end loop 34 of the strap portion around a "U"-shaped section 36 extending from an adjacent side of case 32. The two strap portions 28 and 30 are provided with releasable fastening elements, so that they may be fastened together in a loop extending, for example, as shown in FIG. 1, over the wrist. Suitable releasable fastening elements are sold under the trademark "Velcro" by Velcro, USA. To use fastening elements of this kind, a pad 38 is sewn in place at an end of the inner side of first strap portion 28, while a pad 40 is sewn in place an end of the outer side of second strap portion 30. Pad 38 has a multiplicity of small loops, while pad 40 has a multiplicity of small hooks extending outward to engage the loops of pad 38 after strap portions 28 and 30 are formed into a loop, being curved in the directions indicated by arrows 41. Strap portions 28 and 30 are preferably otherwise composed of a flexible elastic textile material, which is cut and sewn to form the required shapes. Thus, strap 12 is of a suitable length to extend, for example, around the wrist of the user, with the elastic properties of the material forming the major parts of strap portions 28 and 30 being sufficient to bring adequate pressure to bear through central protrusion 26 and to compensate for differences in wrist size among various users. The effective length of strap 12 may also be varied by varying the distance through which pads 38 and 40 are overlapped before they are pressed together.

However, a number of other uses of massage device 10 require a significantly longer strap. For example, the strap may be extended around the head of the user to apply pressure and vibration to a pressure point used in the alleviation of headaches. For this reason, an extension strap 42 is provided, with a central elastic portion 43, a pad 44 having a multiplicity of hooks to engage the loops of pad 38, and a pad 45 having a multiplicity of loops to engage the hooks of pad 40. In this way, the effective length of the strap is significantly increased, with adjustability being provided again by varying the overlap of the various pads before they are engaged. This capability may be increased by lengthening one of the pads, such as loop pad 45.

Figure 3:
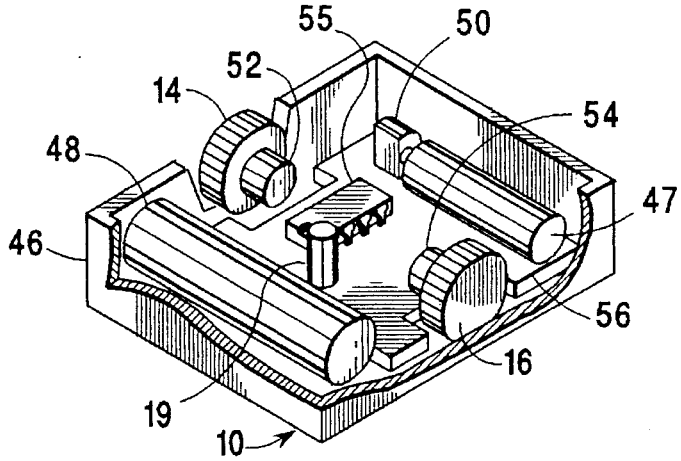
FIG. 3 is an isometric view showing various major elements within the massager of FIG. 1.

FIG. 3 is an isometric view of the major elements within the massage device 10. Various portions of a case 46 of device 10 are shown as being cut away to reveal these elements. Vibrations are produced by the rotation of a small direct current motor 47, which is driven by a pair of batteries 48. An eccentric weight 50 is fastened to the shaft (not shown) of the motor 47, so that vibrations are produced with rotation of the motor. The shaft of a frequency control potentiometer 52 is turned by the rotation of frequency control knob 14, while the shaft of a duty cycle control potentiometer 54 is turned by the rotation of duty cycle control knob 16. Along with a variable resistor, frequency control potentiometer 52 includes a switch which is used to turn the massage device 10 off as the frequency of vibrations is turned all the way down, in the manner of a typical radio volume control. Various control circuits 55 are mounted on a circuit board 56. These major elements are attached, one to another, in such a way that vibrations occurring at the bearings (not shown) within motor 47 due to the eccentric shaft loading from weight 50 are transmitted to case 46, and particularly to central protrusion 26. For example, motor 47 may be attached to circuit board 56, which is in turn attached to case 46.

Figure 4:
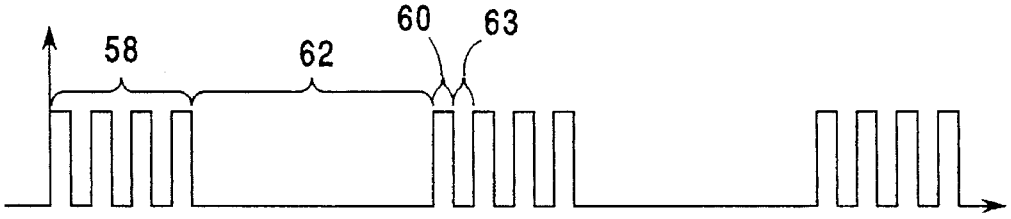
FIG. 4 is a timing diagram of the current pulses used to drive a motor within the massager of FIG. 1, in order to produce vibrations.

FIG. 4 is a timing diagram showing the application of current through motor 47. Current is applied in a series of "major" pulses 58, each of which is divided into a number of smaller "minor" pulses 60. Each "major" pulse 58 is six seconds long. The duration adjustment available with duration control knob 16 is actually a time delay adjustment controlling the time delay 62 inserted between each "major" pulse 58. This time delay is adjustable from 0.1 to 20 sec. When the minimum time delay is selected, the device is perceived by the user as being constantly turned on.

The speed of motor 47, and hence the amplitude and frequency of vibrations produced by the massage device 10, is controlled by varying the duration of the time delay between the "minor" pulses 60. Each "minor" pulse 60 is 0.1 sec in duration, and the time delay 63 between these pulses 60 can be adjusted to be between 0.006 and 0.5 sec. These times are short enough that, when the rotational inertia of motor 47 and eccentric weight 50 are also considered, variations in these times are perceived as changes in the intensity of vibrations produced by the device 10, instead of as variations in a pattern in which the device is turned on and off. Changes in the intensity of vibrations occur when both the frequency and amplitude of vibrations is changed by varying the speed of motor 47. Over most, if not all, of the range of variation of the time delay between "minor" pulses, motor 47 does not completely stop between "minor pulses."

Figure 5:
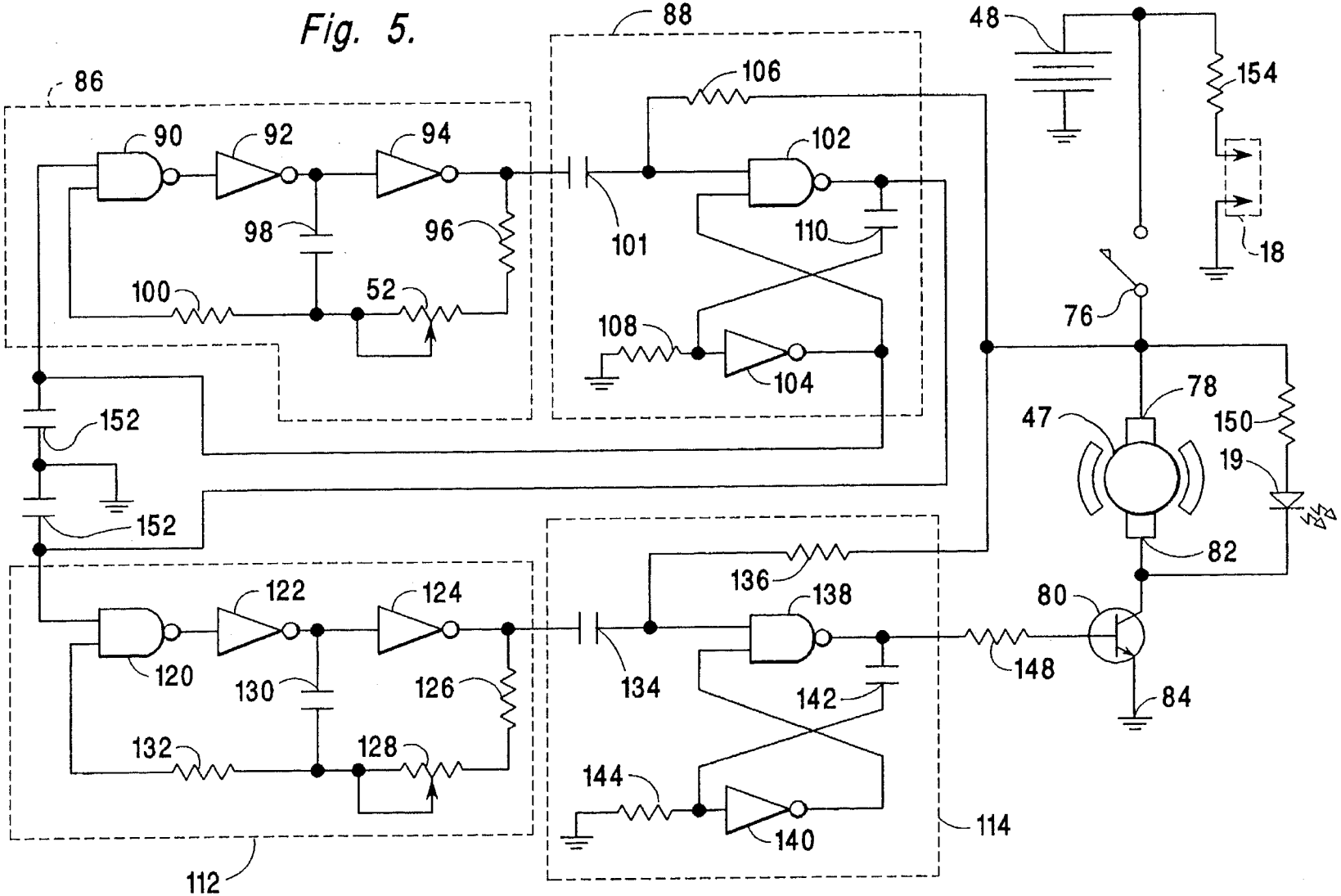
FIG. 5 is a schematic view of the circuit used to produce and control vibration in the massager of FIG. 1.

FIG. 5 is a schematic view of the circuits used to operate the small direct current motor 47, which is preferably of a permanent-magnet type, using power supplied by either the 2.4-volt rechargeable internal battery 48 or by an external direct current power source (not shown) attached to connector 18. When the external power source is attached in this way, it can be used both to provide power to run the device or to recharge battery 48. A switch 76, which is provided as part of frequency control potentiometer 52 (shown in FIG. 3), is used to turn operation of the device on and off, with operation of the device only occurring when the switch 76 is closed, applying a positive directly to a first motor terminal 78, so that motor 47 is turned off and on by switching transistor 80, which provides a switchable connection between second motor terminal 82 and electrical ground at line 84.

The duty cycle control function is provided with a first timer 86 and a first one-shot 88. First timer 86 is a variable-frequency oscillator including a NAND gate 90 and inverters 92 and 94. The frequency of this oscillator is determined by the time constant of the feedback loop extending around inverter 94, consisting of resistor 96, variable resistor 52, and capacitor 98. For example, a variable time delay of 0.1 to 20 seconds is obtained using a resistance of 3.9K ohms for resistor 96, a variable resistance of 0 to 5 megohms for variable resistor 52, and a capacitance of 10 microfarads for capacitor 98. Resistor 100, having a value of 100K ohms, provides an input to NAND gate 90, assuring that the oscillator remains stable.

The negative transition of the output of first timer 86 triggers a monostable one-shot 88, which includes an input capacitor 101, a NAND gate 102, an inverter 104, resistors 106 and 108, and a capacitor 110. Input capacitor 101 has a capacitance of 0.01 microfarad, and resistor 106 has a resistance of 2.2 megohms. While the voltage applied through resistor 106 tends to hold the associated input to NAND gate 102 high, the negative transition pulse provided through input capacitor 101 serves to switch this NAND gate 102. For example, resistor 108 has a value of 2.2 megohms, and capacitor 110 has a value of 3.3 microfarads, so that the one-shot 88 repeatedly produces a six-second pulse when triggered. This pulse, which occurs at the output of NAND gate 102 is used to turn on motor 47 through a second timer circuit 112 and a second one-shot 114. The output of inverter 104, which essentially operates opposite to NAND gate 102, is provided as an input to NAND gate 90 in order to close a loop between first timer 86 and first one-shot 88. In this way timer 86 is prevented from triggering a new pulse before the pulse from one-shot 88 is completed. This feature of the circuit is needed to assure that switching does not occur within timer 86, during each constant-length pulse from one-shot 88.

Second timer 112 and second one-shot 114 are similar in configuration to first timer 86 and first one-shot 88, with a major difference being that resistive and capacitive values have been changed to effect much shorter time constants. In timer 112, which includes a NAND gate 120 and inverters 122 and 124, resistor 126 has a resistance of 3.9K ohm, variable resistance 128 has a resistance adjustable between 0 and 5 megohms, and capacitor 130 has a capacitance of 0.2 microfarad, providing, for example, a time constant adjustable between 0.006 and 0.5 sec. Resistor 132, having a resistance of 100K ohms, is provided to maintain stable operation within second timer 112.

The output of second timer 112 is provided as an input to trigger second one-shot 114 through an input capacitor 134, which operated with a resistor 136, so that the negative pulse transition from invertor 124 switches NAND gate 138. Resistor 136 has a resistance of 100K ohms, while capacitor 134 has a capacitance of 0.01 microfarad. Second one-shot 114 also includes a NAND gate 138 and an invertor 140, a capacitor 142, and a resistor 144. Capacitor 142 has a capacitance of, for example, 1 microfarad, while resistor 144 has a resistance of 100K ohms, to provide a time constant of 0.1 sec. Thus, second one-shot 114 produces an output pulse having a duration of 0.1 sec. each time it is triggered by the output of second timer 112.

The output of NAND gate 102 in first one-shot 88 is provided as an input to NAND gate 120, so that the operation of second timer 112 is enabled only during the 6-second pulses provided by first one-shot 88. The output of second one-shot 114 is provided through resistor 148 as an input to the base of transistor 80, which is thus turned on during each 0.1-sec output pulse from second one-shot 114. Resistor 148, which has a resistance of 1K ohms, limits the base current of transistor 80. When transistor 80 is switched on in this way, current is conducted through motor 47, causing vibrations to occur with the rotation of eccentric weight 50 (shown in FIG. 3).

LED 19 is wired parallel to motor 47 and in series with resistor 150, so that light is produced by the LED whenever the motor is turned on. Resistor 150, which has a resistance of 240 ohms, limits the current through LED 19.

Switching inputs to NAND gates 90 and 120 are coupled to logic ground through 0.01-microfarad capacitors 152 to prevent these gates 90 and 120 from being switched by extraneous electromagnetic energy, which may result from the operation of motor 47, or even from a source external to the device 10.

Battery 48 is preferably a rechargeable device, which can be recharged by the application of electrical current from an external charger (not shown) through connector 18. Connector 18 is preferably keyed to assure that the charger is properly plugged in. Otherwise, a diode (not shown) may be placed between battery 48 and the connector 18 to assure that current does not flow in the wrong direction. A resistor 154 is placed in this path to limit the current flowing during battery charging. The current flowing through connector 18 can be used for the operation of the device 10, with switch 76 closed, as well as for recharging battery 48 with switch 76 open or closed.

Thus, a vibrating massager built in accordance with the present invention is particularly useful, as it can be adjusted by the user to provide a number of different sequences or patterns of vibration at different frequencies.

While the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

What is claimed is:

1. A vibrating massager comprising:

first electronic pulse generating means for forming a first series of electrical pulses, wherein said first electronic pulse generating means includes adjustment means for varying each first variable time occurring between a pulse transition in a first direction and a next pulse transition occurring in a direction opposite said first direction, while each time occurring between a pulse transition opposite said first direction and a next pulse transition occurring in said first direction remains constant;

vibration generating means for producing mechanical vibrations, said vibration generating means being driven according to said first series of electrical pulses, wherein said vibration generating means is turned on by said electrical pulses during pulse transitions opposite said first direction, and wherein said vibration generating means is turned off during pulse transitions in said first direction, whereby variation of said adjustment means varies each time delay during which said vibration generating means is turned off between times in which said vibration generating means is turned on while said vibration generating means is left on for a constant pulse duration; and a housing, surrounding said first electronic pulse generating means and said vibration generating means, transmitting mechanical vibrations produced by said vibration generating means to a protrusion forming a closed integral part of said housing, said protrusion extending outward from a surrounding exterior surface of said housing.

2. The vibrating massager of claim 1, wherein said vibration generating means includes a motor spinning an eccentric weight.

3. The vibrating massager of claim 2, wherein said vibration generating means additionally includes speed control means for varying a rotational speed of said motor.

4. The vibrating massager of claim 3 wherein said speed control means has second electronic pulse generating means for forming a second series of electrical pulses, with said second electronic pulse generating means including adjustment means for varying each second variable time occurring between a pulse transition in a second direction and a next pulse transition occurring in a direction opposite said second direction, with said second variable time being substantially shorter than said first variable time;

wherein, within said first series of electrical pulses, a first fixed time elapses between each pulse transition in a direction opposite said first direction and a next pulse transition in said first direction;

wherein, within said second series of electrical pulses a second fixed time elapses between each pulse transition in a direction opposite said second direction and a next pulse transition in said second direction, said second fixed time being substantially shorter than said first fixed time; and wherein said motor is driven in response to said second series of pulses.

5. The vibrating massager of claim 4, wherein said second series of electrical pulses is started by said pulse transition occurring in a direction opposite said first direction and stopped by said pulse transition occurring in said first direction.

6. The vibrating massager of claim 1, comprising in addition:

an electrical battery within said housing, providing power for said first electronic pulse generating means and said vibration generating means; and strap means for extending around a body member to hold said exterior surface against said body member.

7. The vibrating massager of claim 6, wherein said strap means includes:

a first strap portion extending outward from a first side of said housing, with first connection means at an end of said first strap portion; and a second strap portion extending outward from a second side of said housing, said second side being opposite said first side, with second connection means at an end of said second strap portion, said second connection means being releasably connectable to said first connection means as said first and second straps are formed into a loop.

8. The vibrating massager of claim 7, wherein said strap means additionally includes a third strap portion, with third and fourth connection means at opposite ends thereof, with said third connection means being releasably connectable to said first connection means, and with said fourth connection means being releasably connectable to said second connection means.

9. The vibrating massager of claim 1, wherein each said time occurring between said pulse transition opposite said first direction and said next pulse transition in said first direction is six seconds, whereby said constant pulse duration is six seconds.

10. A vibrating massager comprising:

vibration generating means including a motor spinning an eccentric weight for producing mechanical vibrations;

a housing, surrounding said vibration generating means, transmitting mechanical vibrations produced by said vibration generating means to a protrusion forming an integral portion of said housing, said protrusion extending outward from a surrounding exterior surface of said housing; and speed control means for varying a rotational speed of said motor, wherein said speed control means includes first and second timing circuits, connected so that an output of said first timing circuit forms an input to said second timing circuit, and motor switching means connected to an output of said second timing circuit; wherein said first timing circuit produces a first intermediate signal transition on said output thereof, at a first variable time following a signal transition on an input thereof, wherein said second timing circuit produces a first output signal transition in a first direction as a signal transition occurs on said input thereof, and a first output signal transition opposite said first direction at a first fixed time following a signal transition on said input thereof, and wherein said motor switching means drives said motor between said first output signal transition in a first direction and said first output signal transition opposite said first direction.

11. The vibrating massager of claim 10 wherein said vibrating massager additionally comprises third and fourth timing circuits, connected so that an output of said third timing circuit forms an input to said fourth timing circuit, with an output of said fourth timing circuit connected as an input to said first timing circuit;

wherein said third timing circuit produces a second intermediate signal transition on said output thereof, at a second variable time following a signal transition on said input thereof;

wherein said fourth timing circuit produces a second output signal transition in a second direction as a signal transition occurs on said input thereof, and a second output signal transition opposite said second direction at a second fixed time following a signal transition on said input thereof; and wherein said first timing circuit operates between said second output signal transition in a second direction and said second output signal transition opposite said second direction.

12. The vibrating massager of claim 11, wherein said first and second variable times are adjustable by rotation of knobs externally accessible on said housing.

13. The vibrating massager of claim 11 wherein said second variable time is substantially longer than said first variable time; and wherein said second fixed time is substantially longer than said first fixed time.

14. The vibrating massager of claim 13, wherein an output of said fourth timing circuit is connected as an input to said third timing circuit to prevent switching of said third timing circuit between said second output signal transition in a second direction and said second output signal transition opposite said second direction.

15. The vibrating massager of claim 13, wherein said second variable time is six seconds.

* * * * *